United States Patent [19]

Cates

[11] 4,071,046

[45] Jan. 31, 1978

[54] DIRECTIONAL CONTROL POPPET VALVE

[76] Inventor: H. Alton Cates, 1119 Elmherst, Dallas, Tex. 75224

[21] Appl. No.: 730,651

[22] Filed: Oct. 7, 1976

[51] Int. Cl.[2] ..... F15B 13/04; F15B 13/043

[52] U.S. Cl. ..... 137/596.15; 137/596.16; 137/596.2; 137/627.5; 91/454; 91/465

[58] Field of Search ..... 137/596.14, 596.15, 137/596.16, 596, 596.2, 627.5; 91/454, 457, 459, 465

[56] References Cited

U.S. PATENT DOCUMENTS

| | | | |
|---|---|---|---|
| 1,955,154 | 4/1934 | Temple | 137/596.2 X |
| 3,038,500 | 6/1962 | Lansky et al. | 137/596.15 |

*Primary Examiner*—Edgar W. Geoghegan
*Attorney, Agent, or Firm*—Richards, Harris & Medlock

[57] ABSTRACT

A valve system for controlling the direction of flow of pressurized fluid. The valve system includes a valve housing, with an inlet port for receiving pressurized fluid therein, a first cylinder port and a second cylinder port. The housing is further constructed with first and second exhaust ports. Passageways connect the inlet port to the first cylinder port and to the second cylinder port. Passageways also extend from the first cylinder port to the first exhaust port and from the second cylinder port to the second exhaust port. A pair of pistons and corresponding poppet valves are slidable within the housing to control flow of fluid through the passageways. In one embodiment, the pistons and poppet valves are moved by communicating fluid pressure from the inlet port either above or below the pistons. In an alternative embodiment, the pistons and popper valves are mechanically actuated.

22 Claims, 8 Drawing Figures

DIRECTIONAL CONTROL POPPET VALVE

BACKGROUND OF THE INVENTION

This invention relates to directional valves and more particularly to a four-way, three-position poppet valve.

It is advantageous in many fluid control systems to have a directional valve structure having four selectable flow paths to control fluid flow from a pressure source to the apparatus being activated by the fluid. These "four-way" valves have heretofore been of several general types. The spool valve type generally includes a housing having an elongated bore with lateral inlet, outlet and exhaust ports communicating from the exterior of the housing to the bore area. A shaft is axially movable within the bore, and cylindrical enlargements or bosses on the shaft overlay various ports in different longitudinal positions to control the fluid flow from the inlet port to the outlet and exhaust ports and from the outlet ports to the exhaust ports. To prevent leakage between the shaft and the bore walls, these bosses are often provided with seals such as O-rings, which slidably engage the wall of the bore. These seals tend to wear rapidly as they must pass over the edges of the ports during the operation of the unit.

Another general type of four-way valve system includes a housing having an elongated bore therethrough with ports extending between the side wall of the housing. In contrast to the first type, this type of valve has valve seats extending radially inward from the walls of the bore between the ports, and the movable shaft within the bore is provided with poppet heads fixed on the shaft and arranged to engage selected valve seats as it is moved longitudinally within the bore. As the poppet heads move on a single shaft, to properly seal the fluid channels formed by the poppet heads against the valve seats, the seals of at least two poppet heads must engage two valve seats at the same time. Therefore, the two poppet heads must be exactly the same distance apart as their two respective valve seats. The required accuracy is so great that normal manufacturing tolerances are unacceptable, and the cost of making such valves is undesirably high. To overcome this difficulty, valves have been provided having movable valve seats in order to permit simultaneous sealing of poppet heads against valve seats as required. However, these valve systems require additional complex movable parts and additional seals which add to the cost and complexity of the unit.

Additionally, in this latter type of poppet valve structure, the prior art units have generally provided only two positions, that is fluid flow through two paths or fluid flow through the two alternative paths. Thus, in many of the prior art units, no center or neutral position, that is where all ports are either blocked or open, is provided.

SUMMARY OF THE INVENTION

The present invention provides a four-way, three-position poppet directional valve which overcomes many of the disadvantages of the prior art units. The present invention provides for selecting four fluid paths whereby input pressure may be communicated from an inlet port to a first cylinder port while a second cylinder port is communicated to its respective exhaust port. In the second position, fluid pressure is communicated to the second cylinder port with the first cylinder port communicating with its respective exhaust port. In the third position, all the ports are open or all ports are closed as desired by the particular design of the valve. This valving structure is accomplished without the disadvantages of the spool valves heretofore used and without the dimensional tolerances heretofore experienced with present poppet valves.

In accordance with one embodiment of the invention, a valve system for controlling the direction of flow of pressurized fluid to opposite ends of the cylinder of a servo motor to actuate the piston of the servo motor in opposite directions is disclosed. The valve system includes a valve housing, with an inlet port for receiving pressurized fluid therein. A first cylinder port is provided in the housing and communicates with one end of the cylinder of the servo motor. The housing has a second cylinder port which communicates with the opposite end of the servo motor. The housing is further adapted with first and second exhaust ports. A first passageway extends from the inlet port to the first cylinder port and a second passageway extends from the inlet port to the second cylinder port. A third passageway extends from the first cylinder port to the first exhaust port, and a fourth passageway extends from the second cylinder port to the second exhaust port.

A first poppet valve is slidable within the housing and is normally seated against a valve seat in the housing to close the first passageway. Similarly, a second poppet valve slidably received within the housing is normally seated against a valve seat within the housing to close the second passageway. A first piston slides within the valve housing and normally engages the first poppet valve to close the third passageway. A second piston is slidable within the valve housing and normally engages the second poppet valve to close the fourth passageway. Structure is provided for moving the first and second piston to selectively open and close the various passageways thereby controlling the flow of fluid through the valve system.

In accordance with a more specific aspect of the invention, the movement of the pistons is provided by communicating the fluid pressure from the inlet port either above or below the piston heads. When fluid pressure is communicated above the piston heads, the pistons are moved against the poppet valve to unseat the poppet valve from the valve seat formed by the housing. This in turn opens the passageway from the inlet port to one of the cylinder ports. By communicating fluid pressure beneath the head of one of the pistons, the piston is unseated from engagement with the poppet valve thereby opening one of the passageways from one of the cylinder ports to its corresponding exhaust port.

In accordance with another aspect of the invention, a first flow passage extends from the inlet port to an upper chamber above the first piston and to a lower chamber below the second piston. A valve for normally closing the first flow passage is provided. Thus, by opening and closing the valve, fluid pressure from the inlet port is communicated through the first flow passage to depress the first piston thereby opening the passageway between the inlet port and the first cylinder port while simultaneously raising the second piston to open the passageway between the second cylinder port and its corresponding exhaust port. A similar flow passage exists from the inlet port to an upper chamber above the second piston and to a lower chamber below the first piston and is similarly controlled by a valve to selectively communicate fluid pressure below the first piston and above the second piston to simultaneously open the passageway from the inlet port to the second cylinder port and the passageway between the first cylinder port and its respective exhaust port. Thus, fluid pressure is controlled between the inlet port and one of the cylinder ports and between the cylinder ports and their respective exhaust ports.

In accordance with another aspect of the invention, the pistons are controlled manually by activation of a lever which engages the pistons and permits the translation of the pistons in opposite directions.

DESCRIPTION OF THE DRAWINGS

A more complete understanding of the invention may be had by reference to the following detailed description when taken in conjunction with the accompanying drawings, wherein.

DESCRIPTION OF THE PREFERRED EMBODIMENTS

Figure 1:
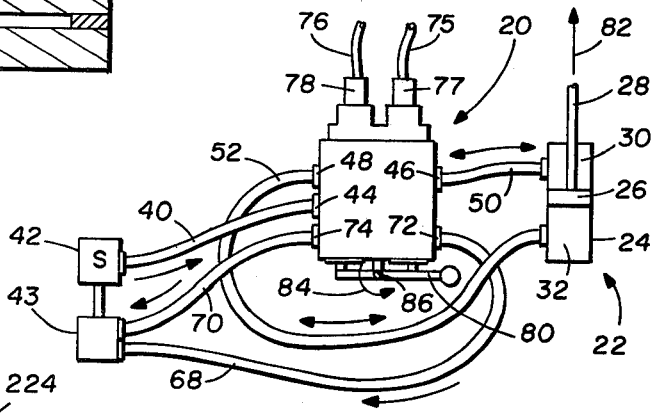
FIG. 1 is a schematic view of the valve assembly of the invention connected to a servo motor to be controlled by the valve assembly.

FIG. 1 illustrates in schematic view a valve assembly indicated generally by the numeral 20 connected to a servo motor 22 for operation of the motor. Servo motor 22 includes a cylinder housing 24 having a piston 26 slidable therein and a piston rod 28 adapted for movement with piston 26. Piston rod 28 is connected at its end opposite piston 26 to any chosen device which the valve assembly 20 is to operate. Piston 26 divides the cylinder chamber formed within cylinder housing 24 into an upper chamber 30 and a lower chamber 32. A conduit 40 delivers pressurized fluid from a fluid pressure source 42 supplied by reservoir 43 to an inlet port 44 of valve assembly 20. Cylinder ports 46 and 48 of valve assembly 20 are connected by conduits 50 and 52, respectively, to communicate with chambers 30 and 32, respectively, of servo motor 22. Exhaust lines 68 and 70 extend from exhaust ports 72 and 74, respectively, and are connected at their opposite ends to reservoir 43. Where the fluid is air, lines 68 and 70 will exhaust to the atmosphere. In this case, reservoir 43 is eliminated.

Electrical leads 75 and 76 extend from an electrical power source (not shown) to solenoids 77 and 78, respectively, within valve assembly 20. Handle assembly 80 is attached to the lower portion of valve assembly 20 and may be used as a manual override to control the valve system.

As will be discussed in greater detail hereinafter, when solenoid 78 of valve assembly 20 is actuated, pressurized fluid is communicated from conduit 40 through valve assembly 20 exiting from port 48 and through conduit 52 to chamber 32 of servo motor 22. Simultaneously therewith, fluid flows from chamber 30 through conduit 50 into valve assembly 20 and through exhaust line 68 to fluid pressure source reservoir 43. Again, where the fluid is air, it is normally exhausted to the atmosphere.

Thus, when solenoid 78 is actuated, valve assembly 20 operates to activate servo motor 22 such that piston 26 and piston rod 28 move upwardly as illustrated by arrow 82 in FIG. 1.

When solenoid 77 is actuated, pressurized fluid flows from conduit 40 into valve assembly 20 and from port 46 through conduit 50 into chamber 30 of servo motor 22. Simultaneously therewith, fluid from chamber 32 of servo motor 22 flows through conduit 52 into port 48 of valve assembly 20 and is discharged from exhaust port 74 through exhaust line 70 into the fluid reservoir 43 or to the atmosphere. Thus, by actuating solenoid 77, piston 26 and piston rod 28 are moved downwardly in servo motor 22 in the reverse direction of arrow 82 of FIG. 1.

The valve assembly is equipped with a manual override activated by handle 80. By pivoting handle 80 counterclockwise in the direction of arrow 84 of FIG. 1 about axis shaft 86, fluid pressure from fluid source 42 flows through valve assembly 20 and out of port 48 into chamber 32 of servo motor 22. Simultaneously therewith, fluid flows from chamber 30 through conduit 50 into port 46 to be exhausted from port 72 through line 68 to hydraulic fluid reservoir 43 or to the atmosphere. Thus, piston 26 and piston rod 28 are made to move upwardly in the direction of arrow 82. Similarly, by rotating handle 80 clockwise in the reverse direction of arrow 84 of FIG. 1, fluid pressure from source 42 flows through conduit 40 into valve assembly 20 and from port 46 through conduit 50 to chamber 30 of servo motor 22. At the same time, fluid flows from chamber 32 through conduit 52 into port 48 of valve assembly 20 and is discharged through port 74 and line 70 to hydraulic fluid reservoir source 43 or exhausted to the atmosphere.

When neither solenoid 77 or 78 is actuated and with handle 80 in the neutral position, fluid flowing from source 42 through conduit 40 is blocked within valve assembly 20 and no fluid passes into or out of ports 46 or 48 or from exhaust ports 72 and 74.

Figure 2:
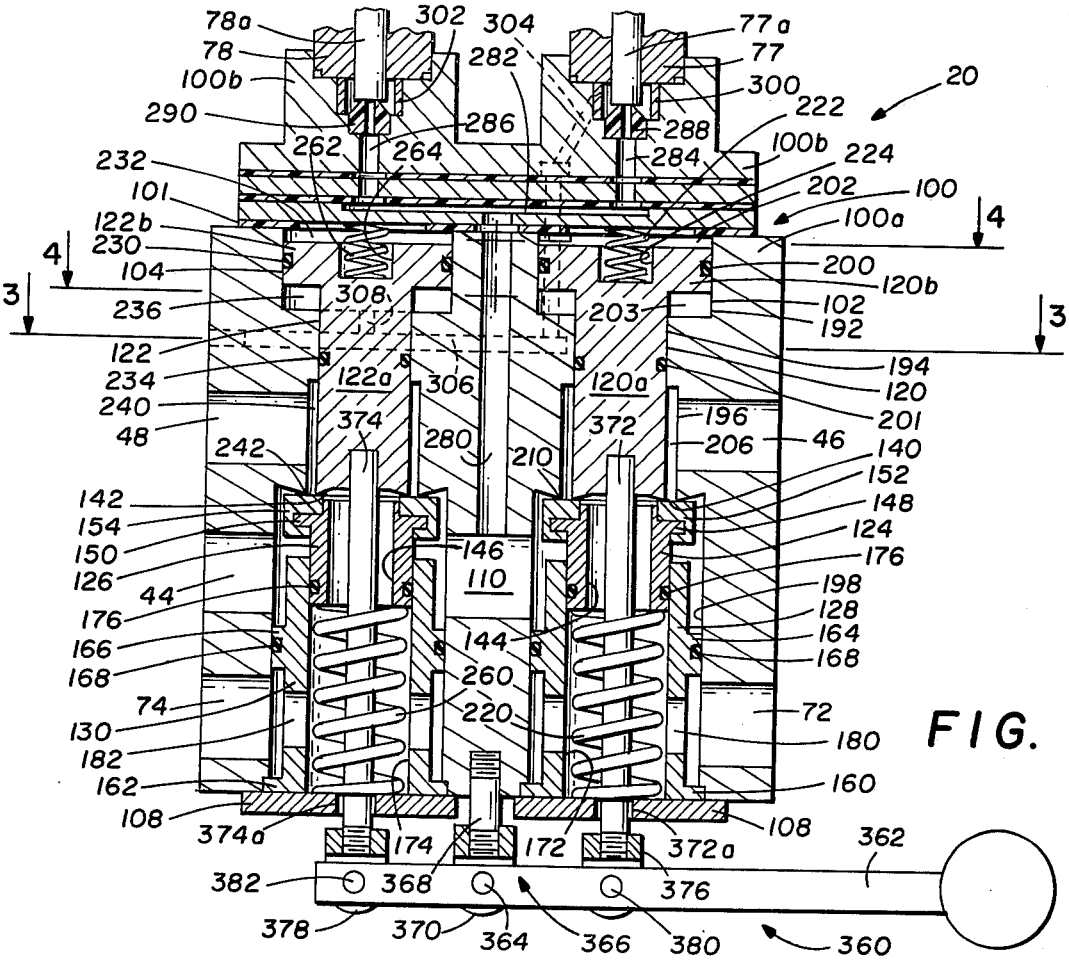
FIG. 2 is a vertical section view of the valve assembly of the present invention showing the valve in the neutral or third position.

FIG. 2 illustrates a vertical section view of valve assembly 20 with the valve in a centered or third position. Valve assembly 20 includes a housing 100 with a lower housing 100*a* and an upper housing 100*b* suitably attached with a gasket 101 therebetween. Upper housing 100*b*, while actually constructed in three sections with gaskets fitted therebetween to facilitate forming passages therein, will be referred to as a single composite unit. Lower housing 100*a* has two parallel elongated bores 102 and 104 extending substantially the full length of the body and each having its upper end closed by upper housing 100*b* and a lower end closed by plate 108 attached to housing 100. The ports previously mentioned all communicate laterally with bores 102 and 104. These ports comprise cylinder ports 46 and 48 and exhaust ports 72 and 74. Fluid power inlet port 44 communicates through housing 100 into bore 104 and includes a connecting chamber 110 connecting bores 102 and 104.

Bores 102 and 104 are composed of varying sizes of concentric bores to accommodate a pair of pistons 120 and 122, respectively. Poppet valves 124 and 126 are slidably engaged within poppet guides 128 and 130, respectively. Pistons 120 and 122 consist of a constant diameter shaft 120*a* and 122*a*, respectively, with a larger diameter cylindrical head 120*b* and 122*b*, respectively.

The lower circumferential edge of shaft portions 120*a* and 122*a* of pistons 120 and 122 are formed with a knife edge 140 and 142 for sealingly engaging poppet valves 124 and 126 as will hereinafter be discussed in greater detail.

Poppet valves 124 and 126 are formed as cylinder members having longitudinal bores 144 and 146 extending longitudinally therethrough. The upper portions of poppet valves 124 and 126 are formed with flanges 148 and 150 to receive elastomeric circular seals 152 and 154, respectively.

Poppet guides 128 and 130 are cylindrical members having lower flanges 160 and 162 for engaging lower housing 100*a*. Guides 128 and 130 are each adapted with annular rib protrusions 164 and 166, respectively, which receive an elastomeric seal 168, such an O-ring, to form a seal between protrusions 164 and 166 and bores 102 and 104.

Poppet guides 128 and 130 have cylindrical concentric bores 172 and 174 extending longitudinally therethrough, respectively. Poppet valves 124 and 126 have an outside diameter substantially equivalent to the diameter of the inner bores 172 and 174 of guides 128 and 130 and are received for slidable engagement within guides 128 and 130, respectively. Poppet valves 124 and 126 are each provided with annular grooves for receiving elastomeric seals 176 to form a sealing engagement between the outer wall of the poppet valves and the inner wall of the guides 128 and 130.

Guides 128 and 130 are provided with lateral bores 180 and 182, respectively, for communicating between exhaust ports 72 and 74, and inner bores 170 and 172 of guides 128 and 130.

Referring now to bore 102 which receives piston 120 and poppet valve 124, bore 102 includes concentric bores 192, 194, 196 and 198. Bore 192 is sized to receive cylindrical head 120*b* of piston 120. Piston head 120*b* has an annular groove therearound for receiving an elastomeric seal 200, such as an O-ring, for forming a seal between head 120*b* and bore 192 of longitudinal bore 102. Bore 194 is sized to receive shaft 120*a* of piston 120. Shaft 120*a* has an annular groove therearound for receiving an elastomeric seal 201, such as an O-ring, for forming a seal relationship between shaft 120*a* and bore 194 of longitudinal bore 102. An upper chamber 202 is formed between head 120*b* of piston 120 and upper housing 100*b*. Likewise, a lower annular chamber 203 is formed beneath head 120*b* of piston 120 between seals 200 and 201. Bore 196 is larger than bore 194 and the outer diameter of shaft 120*a* of piston 120 and therefore defines an annular chamber 206 about shaft 120*a*. Annular chamber 206 communicates with cylinder port 46.

Bore 198 is sized to slidably receive poppet guide 128 and annular protrusion 164 extending thereabout. Seal 168, retained within annular protrusion 164, forms a sealing relationship between casing member 128 and bore 198 of longitudinal bore 102. Bore 198 is larger in diameter than the diameter of seal 152 mounted on poppet valve 124 such that fluid may pass between seal 152 and bore 198.

A circular seat 210 is formed at the point of transition between bore 196 and bore 198 by upwardly chamfering bore 198 at this transition point. Seat 210 serves to facilitate forming a positive seal between the housing and poppet valve 124 as will hereinafter be discussed in greater detail. Guide 128 is maintained in a fixed relationship with respect to housing 100*a* by engaging flanges 160 thereon within a recess formed with housing 100*a*. Poppet valve 124 is slidably engaged with guide 128 and is biased upwardly by spring 220. Piston 120 is slidably recived within bores 192 and 194 of longitudinal bore 102 and is biased downwardly by a spring 222 acting between upper housing 100*b* and a recessed bore 224 within the head of piston 120.

Spring 220 is sufficiently stronger than spring 222 such that poppet valve 124 is normally urged upwardly and seals circular seal 152 against seat 210. Piston 120 is urged downwardly by spring 222 and sealingly engages edge 140 against the upper side of seal 152 of poppet valve 124. However, spring 220 is sufficiently stronger than spring 222 to prevent the engagement of piston 120 against seal 152 of poppet valve 124 from disengaging the seal of 152 against seat 210 formed in housing 100*a*.

Similarly, bore 104 includes a plurality of concentric bores corresponding to those of bore 102 for receiving piston 122, poppet valve 126 and guide 130. As discussed with respect to bore 102 and piston 120, piston head 122*b* of piston 122 has an elastomeric seal 230 therearound for forming a fluid-tight seal between head 122*b* and bore 104. This seal forms a fluid-tight chamber 232 between the top of piston 122 and the lower wall of upper housing 100*b*. Shaft 122*a* of piston 122 likewise has an annular groove therearound for receiving an elastomeric seal 234 which forms a fluid-tight engagement with bore 104. This seal forms a fluid-tight annular chamber 236 below head 122*b*. As described earlier with respect to piston 120, piston 122 is adapted with a knife edge 142 about the lower edge of shaft 122*a* for engaging seal 154 on poppet valve 150. Likewise, an annular chamber 240 is formed between shaft 122*a* and bore 104 which communicates with port 48. A seat 242 extends radially inwardly as bore 104 is enlarged near the lower portion thereof, to sealingly engage seal 154 of poppet valve 126. Poppet guide 130 is fixedly positioned with respect to housing 100 by the engagement of flange 162 within an annular indention within the housing. As previously described, guide 130 has a raised protrusion 166 for receiving an elastomeric seal 168 for engagement with bore 104, and is adapted with a lateral aperture 182 communicating between port 74 and the inner bore 174 of guide 130.

As discussed with respect to piston 120 and poppet valve 124, a spring 260 is positioned between the lower plate 108 forming the lower end of bore 104 and poppet valve 126 to urge valve 126 upwardly such that a seal is normally formed between seal 154 and circular valve seat 242. A spring 262 is positioned between the lower wall of upper housing 100*b* and piston 122 to normally urge piston 122 downwardly to form a seal between lower edge 142 of piston 122 and seal 154 of poppet valve 126. Spring 262 rests within a bore indention 264 which assists in positioning the spring relative to piston 122. While spring 262 exerts a downward force on poppet valve 126, spring 260 is sufficiently stronger than spring 262 such that the seal between the circular seat 242 formed in housing 100 and seal 154 of poppet valve 126 is not broken by the action of spring 262.

Referring still to FIG. 2, additional fluid channeling is provided within valve assembly 20 in order to properly actuate pistons 120 and 122 and poppet valves 124 and 126 in accordance with the present invention. Specifically these fluid passages include a vertical passage 280 extending upwardly and communicating with chamber 110. Passage 280 communicates at its upper end with a passage 282 which in turn communicates at each end thereof with vertical passages 284 and 286. The upper end of passages 284 and 286 are adapted with valves 288 and 290, respectively. Solenoids 77 and 78 are mounted immediately above valves 288 and 290 and solenoid shafts 77*a* and 78*a* are biased against valves 288 and 290, respectively, to normally close the valves thereby preventing the flow of fluid therethrough. Shafts 77*a* and 78*a* act within sleeve members 300 and 302, respectively. A fluid channel 304 communicates through sleeve 300 and extends downwardly therefrom.

Figure 3:
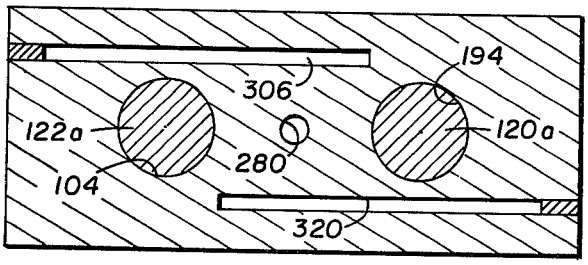
FIG. 3 is a section view taken along line 3—3 in FIG. 2, looking in the direction of the arrows.
Figure 4:
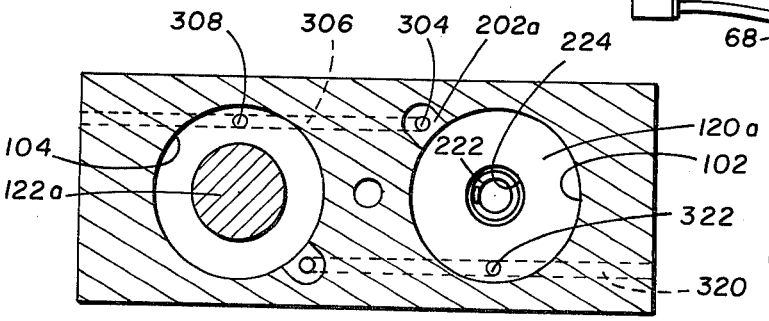
FIG. 4 is a section view taken along the line 4—4 in FIG. 2, and looking in the direction of the arrows.

Referring to FIGS. 2 and 4, it may be seen that fluid channel 304 communicates with chamber 202 formed above head 120*b* of piston 120 and upper housing 100*b* through part 202*a* (FIG. 4). Referring to FIGS. 2, 3 and 4, it may be seen that fluid channel 304 communicates at its lower end with horizontal fluid channel 306. In turn, horizontal channel 306 communicates with vertical channel 308 which extends upwardly from channel 306 to communicate with annular chamber 236 formed below head 122*b* of piston 122. Horizontal channel 306 is plugged at its end remote from its junction with vertical channel 304. Thus, fluid passing through valve 288 is communicated by way of channels 304, 306 and 308 with the chamber above piston 120 and below the head 122*b* of piston 122.

Although not seen in FIG. 2, an identical channeling arrangement exists to communicate fluid flowing through valve 290 with chamber 232 above piston 122 and by way of channels 320 and 322 shown in FIG. 4, to annular chamber 203 below the head 120*b* of piston 120.

Figure 5:
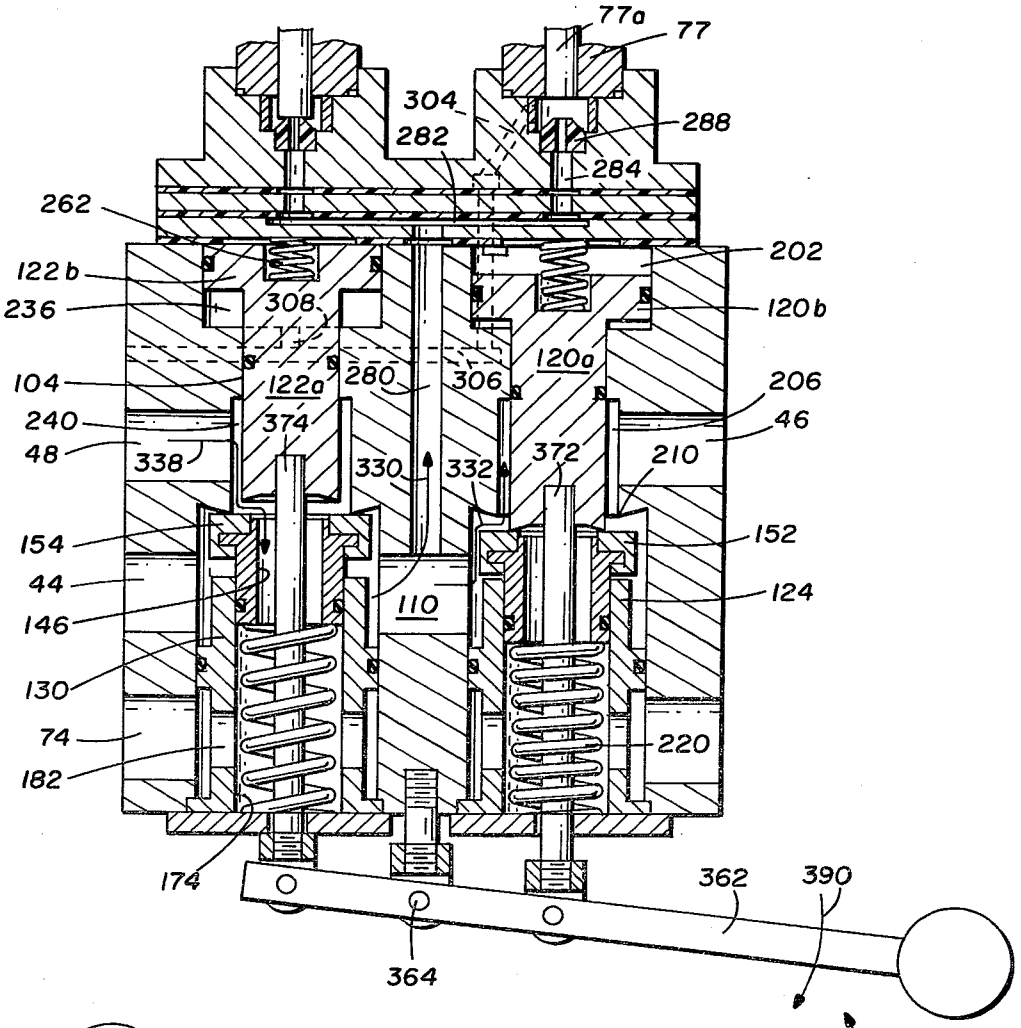
FIG. 5 is a vertical section view of the valve assembly of the present invention showing the valve in the first limit position.
Figure 6:
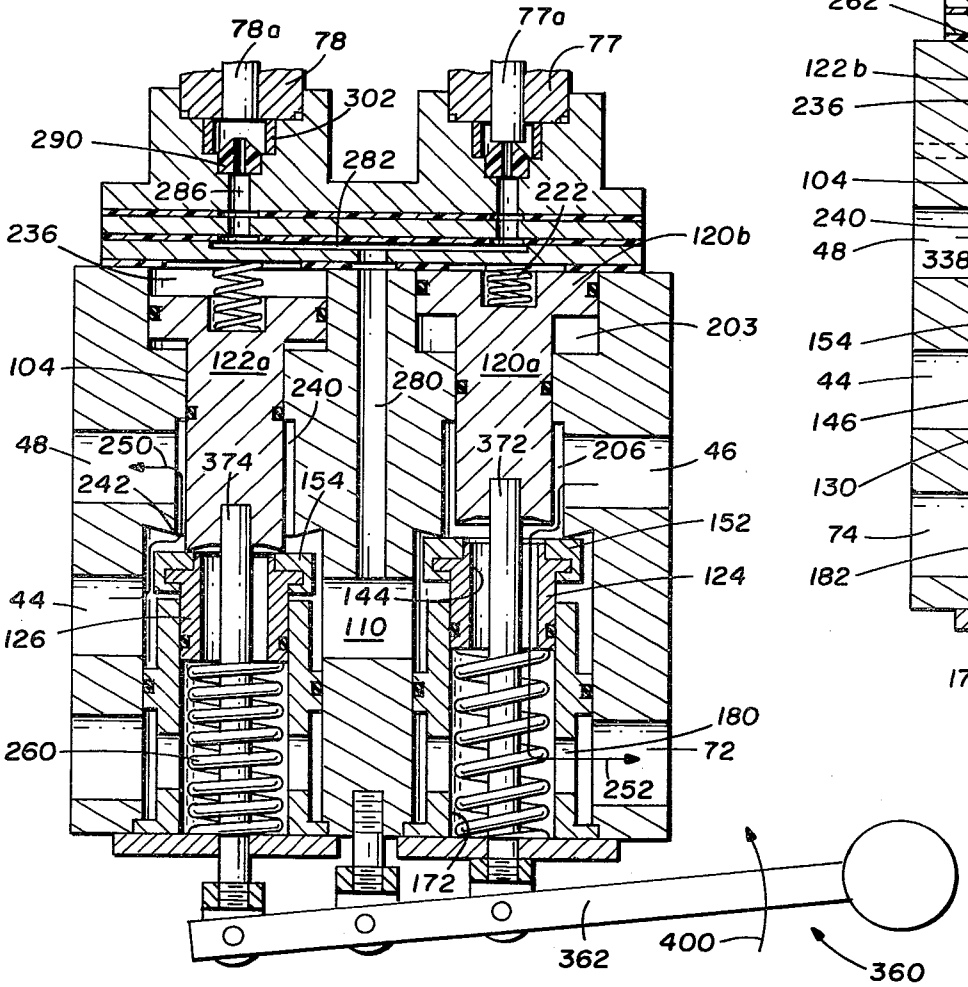
FIG. 6 is a vertical section view of the valve assembly of the present invention with the valve shown in the second limit position.

The operation of the unit is shown by the illustrations of FIGS. 2, 5 and 6 wherein FIG. 2 shows the valve at a neutral position, FIG. 5 shows the valve in the first limit position and FIG. 6 shows the valve in the second limit position. Referring first to FIG. 5, the operation of the valve is as follows. Fluid pressure is supplied at inlet port 44 and is communicated through bore 104 to chamber 110 and along the path of arrow 330 through passages 280 and 282 and passage 284 to valve 288. Fluid pressure is normally sealed at valve 288 by solenoid shaft 77*a* of solenoid 77. In order to actuate the valve to the first limit position, solenoid 77 is actuated such that solenoid shaft 77*a* is retracted upwardly to unseat valve 288.

With retraction of shaft 77*a* of solenoid 77, pressurized fluid is free to flow through valve 288 and into fluid channels 304 to communicate with chamber 202 above head 120*b* of piston 120. Fluid pressure existing in this fluid-tight chamber exerts a downward force on piston 120 sufficient to overcome the spring force of spring 220 acting through poppet valve 124 on piston 120 and unseated seal 152 of poppet valve 124 from circular valve seat 210 of housing 100*a*.

With the unseating of seal 152 from circular seat 210 fluid pressure entering at inlet post 44 communicates through chamber 110 following the path of arrow 332 and passes through annular chamber 206 which communicates with port 46. Thus, port 44 is connected with port 46.

Fluid pressure further communicates through fluid channel 304, channel 306 and vertical channel 308 to communicate with annular chamber 236 below head 122*b* of piston 122. Thus, simultaneously with the downward force applied to piston 120, fluid pressure within fluid-tight chamber 236 exerts an upward force on piston 122 to raise the piston against the action of spring 262. As piston 122 rises in bore 104, fluid at port 48 follows the route indicated by arrows 338 communicating by way of annular chamber 240 through bore 146 of poppet valve 126 through bore 174 of poppet guide 130 and thereafter through lateral bore 182 to exhaust port 74. Thus, port 48 is connected with exhaust port 74 to permit the flow of fluid through valve assembly 20 to exhaust port 74.

Referring to FIG. 6, the reverse or second limit position is illustrated. In this position, fluid pressure entering inlet port 44 is communicated to port 48 and exhaust fluid entering port 46 is communicated to exhaust port 72. This valve connection is accomplished by the retraction of solenoid shaft 78*a* of solenoid 78 to permit the communication of fluid from inlet port 44 through chamber 110, passages 280, 282, 286 and valve 290 to be communicated in a similar manner as described with respect to FIG. 5 to chamber 236 above piston 122 and annular chamber 203 below head 120*b* of piston 120 to simultaneously force piston 122 downwardly to unseat seal 154 from circular valve seat 242 by compressing spring 260 and forcing piston 120 upwardly to unseat piston 120 from seal 152 of poppet valve 124. In the configuration illustrated in FIG. 6, fluid pressure following the path of the arrow generally indicated by the numeral 250 flows through inlet port 44 into annular chamber 240 past the seal 154 and poppet valve 126 to exit from port 48.

Simultaneously therewith, exhaust fluid entering port 46 and following the arrow generally indicated by the numeral 252 passes from port 46 into annular chamber 206 through bore 144 of poppet valve 124 and bore 172 of poppet guide 128 through lateral bore 180 to exhaust port 72. Fluid pressure will continue to flow along these valve channels as long as fluid pressure is input to inlet port 44 and solenoid 78 is energized to unseat shaft 78*a* from valve 290. By simply de-energizing solenoid 78, shaft 78*a* is reseated over valve 290 and springs 260 and 220 and springs 262 and 222 reposition pistons 122 and 120 and poppet valves 126 and 124 to the position illustrated in FIG. 2. In this position, inlet fluid pressure entering inlet port 44 is prevented from communicating either with port 46 or port 48 by the seal created between seals 152 and 154 of poppet valves 124 and 126 against circular valve seats 210 and 242 of housing 100*a*. Additionally, fluid pressure from port 46 is prevented from communicating with exit port 72 and fluid pressure from port 48 is prevented from communicating with exit port 74 by the seal formed between seal 152 and seal 154 and the lower edge of pistons 120 and 122, respectively.

While the primary actuation means for valve assembly 20 are solenoids 77 and 78, the valve assembly may also be actuated manually. As is shown in FIGS. 2, 5 and 6, a handle assembly 360 is attached to the lower face of valve assembly 20 through which the valve assembly may be manually operated. Handle assembly 360 includes a lever arm 362 rotatably pinned by axis shaft 364 to hub assembly 366 attached to the lower face of valve assembly 20. Hub assembly 366 includes a shaft 368 threaded on each end with one end engagable into a mating threaded bore in the valve assembly housing 100. The opposite end is threadedly engaged to a hub 370 which receives axis shaft 364. Threaded shaft 368 permits adjustment of lever arm 362 relative to valve assembly housing 100.

Actuation rods 372 and 374 are pivotally connected along the length of lever arm 362 on opposite sides of the point of connection of hub assembly 366 and lever arm 362. Actuation rods 372 and 374 are fixedly attached at their upper ends to pistons 120 and 122, respectively, and act through seals **372*a* and 374*a* seated in plates 108. The lower ends of actuation rods 372 and 374 are pivotally joined to lever arm 362 by hub assemblies 376 and 378, respectively, which threadedly receive the lower end of actuation rods 372 and 374. Hubs 376 and 378 are pinned for pivotal movement relative to lever arm 362 by axis pins 380 and 382. Rods 372 and 374 are engaged to pistons 120 and 122**, by any suitable means such as by threaded engagement thereto.

Referring to FIG. 5, it may be seen that by rotating lever arm 362 clockwise in the direction of arrow 390, actuation rod 372 is pulled downwardly as the result of the pivoting of lever arm 362 about axis shaft 364 thereby pulling piston 120 downwardly to unseat seal 152 from circular valve seat 210 of housing **100*a*. Simultaneously therewith, actuation rod 374 is moved upwardly thereby unseating piston 122 from seal 154. Thus, fluid from port 44 is communicated along the path illustrated by arrow 332 to port 46, and fluid entering port 48 follows the path illustrated by arrow 338 to exhaust port 74**.

Referring to FIG. 6, as the handle is rotated in the direction indicated by arrow 400, actuation rod 372 is raised to unseat piston 120 from seal 154 and actuation rod 374 is lowered to unseat seal 154 from circular valve seat 242 of housing assembly **100*a*. In this configuration, fluid pressure input to port 44 is communicated along the path indicated by arrow 250 to port 48. Simultaneously therewith, fluid entering port 46 is communicated along the path indicated generally by arrow 252 and is exhausted through exhaust port 72. When no external force is applied to lever arm 362, the valve will assume the neutral or closed position illustrated in FIG. 2. This is the result of the forces exerted by springs 220 and 260 on poppet valves 124 and 126 and springs 222 and 262 on pistons 120 and 122**.

It will be noted that the valve configuration resulting from the rotation of lever arm 362 is identical to that resulting from the actuation of solenoids 77 and 78. Thus, the valve assembly is operable either electrically by the operation of solenoids 77 and 78 or manually by the rotation of lever arm 362.

Figure 8:
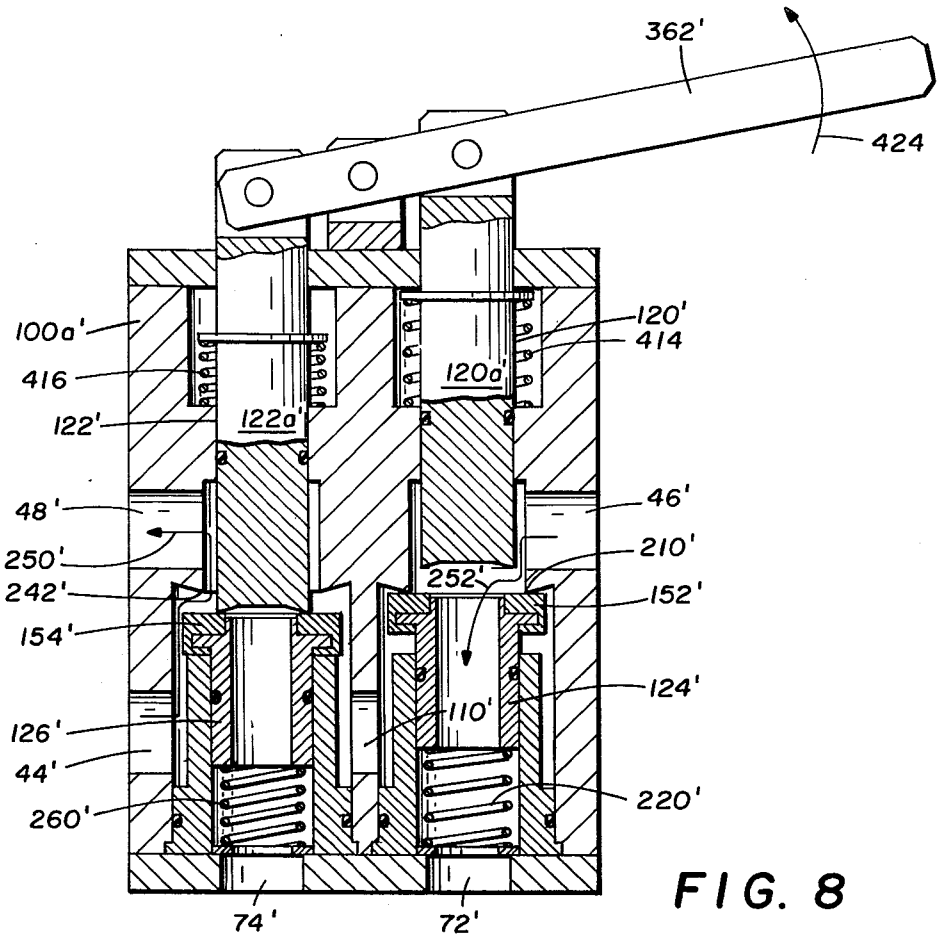
FIG. 8 is a vertical section view of the valve of FIG. 7 with the valve in the first limit position.
Figure 7:
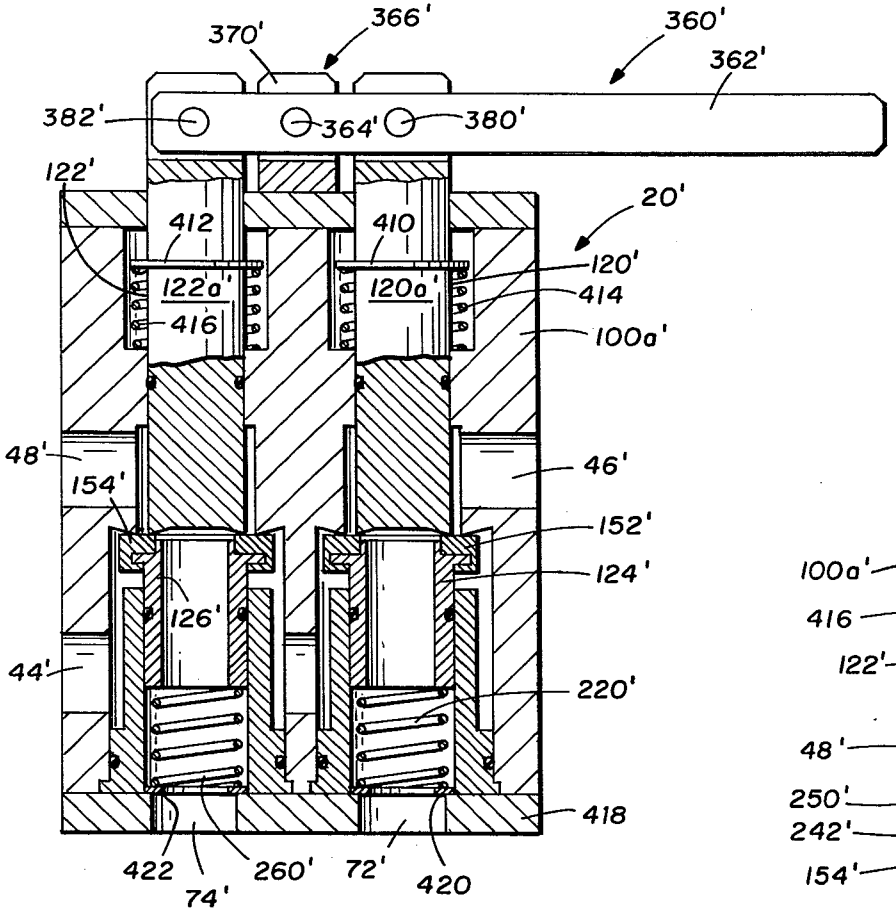
FIG. 7 is an alternative embodiment of the valve of the present invention with the valve in the neutral or third position.

FIGS. 7 and 8 illustrate a manually operated valve assembly forming a second embodiment of the invention which comprises a modification of the embodiment illustrated in FIGS. 1–6. Many of the component parts of the second embodiment of the invention are substantially identical in construction and function to component parts of the embodiment described hereinbefore in conjunction with FIGS. 1–6. Such identical component parts are designated in FIGS. 7 and 8 with the same reference numerals utilized in the description of the first embodiment, but are differentiated therefrom by means of a prime (') designation.

In the second embodiment illustrated in FIGS. 7 and 8, pistons 120' and 122' are manually operated by actuation of handle assembly 360' which is mounted to the top of valve assembly 20'. Handle assembly 360' includes a lever arm 362' pivotally connected to valve assembly 20' by hub assembly 366'. Lever arm 362' pivots about axis pin 364' which rotates in hub 370' of hub assembly 366'. Pistons 120' and 122' are pivotally attached along lever arm 362' on opposite sides of the attachment of lever arm 362' to hub assembly 366' by axis pins 380' and 382'.

Pistons 120' and 122' are fitted with retaining pins 410 and 412, respectively. Actuator springs 414 and 416 are positioned around pistons 120' and 122', respectively, and act between housing **100*a'* and retaining pins 410 and 412 which are fixedly attached to pistons 120' and 122'. The action of actuator springs 414 and 416 tend to center pistons 120' and 122' to equalize the sealing pressure between pistons 120' and 122' and poppet seals 152' and 154' of poppet valves 124' and 126'**.

In the embodiment of FIGS. 7 and 8, exhaust ports 72' and 74' are formed through a bottom plate 418 attached to the bottom of lower housing **100*a'*, but communicate with bores 172' and 174' of poppet guides 128' and 130', respectively, as in the first embodiment. Retaining rings 420 and 422 are seated on bottom plate 418 and are engaged by the lower end of poppet springs 220' and 260'**.

The operation of the valve illustrated in FIGS. 7 and 8 is substantially identical to that described with respect to the first embodiment except that the second embodiment must be manually operated. Referring to FIG. 8, by rotating lever arm 362' in the direction illustrated by arrow 424, piston 120' is raised and piston 122' is lowered in the valve assembly housing. As piston 122' is lowered, seal 154' of poppet valve 126' is unseated from circular valve seat 242' of housing **100*a'*. Thus, fluid entering inlet port 44' follows the path indicated generally by the arrow designated 250' and communicates with port 48'. Simultaneously therewith, piston 120' is raised and the seal between piston 120' and seal 152' of poppet 124' is broken. As a result, fluid entering port 46' communicates along the line indicated generally by the arrow 252' and exits exhaust port 72'**.

By rotating lever arm 362' in the direction opposite arrow 424, fluid entering inlet port 44' communicates with port 46' and fluid entering port 48' exits exhaust port 74' in a similar manner to that discussed with respect to the first embodiment. Where no force is exerted on lever arm 362', seals 152' and 154' of poppet valves 124' and 126' are seated against circular valve seats 210' and 242' by the action of poppet springs 220' and 260'. Likewise, pistons 120' and 122' are seated against seals 152' and 154' of poppet valves 124' and 126' by the action of springs 414 and 416. Thus, with no force exerted on the lever arm 362', inlet fluid entering at inlet port 44' is prevented from communicating with either port 46' or 48' and ports 46' and 48' are sealed from communication with exhaust ports 72' and 74'.

Thus, the present invention provides a four-way, three-position poppet directional valve which may be actuated electrically by a solenoid or other comparable actuating mechanism. The system also provides for a manual override of the valve operation as desired. The valve system is usable with all gases and liquids and provides a unique control design wherein the inlet fluid pressure functions to control the flow path of the fluid through the valve.

Although preferred embodiments of the invention have been described in the foregoing detailed description and illustrated in the accompanying drawings, it will be understood that the invention is not limited to the embodiments disclosed, but is capable of numerous rearrangements, modifications and substitutions of parts and elements without departing from the spirit of the invention.

What is claimed is:

1. A valve system for controlling the direction of flow of a pressurized fluid to opposite ends of a cylinder of a servo motor to actuate the piston of the servo motor in opposite directions, comprising:

a valve housing;

an inlet port for receiving pressurized fluid therethrough;

a first cylinder port in the housing communicating with one end of the cylinder of the servo motor;

a second cylinder port in the housing communicating with the opposite end of the servo motor;

first and second exhaust ports in the housing;

a first passageway extending from the inlet port to the first cylinder port;

a second passageway extending from the inlet port to the second cylinder port;

a third passageway extending from the first cylinder port to the first exhaust port;

a fourth passageway extending from the second cylinder port to the second exhaust port;

a first poppet valve normally seated against the housing to close the first passageway;

a second poppet valve normally seated against the housing to close the second passageway;

a first piston slidable within the valve housing and normally seated against the first poppet valve to close the third passageway;

a second piston slidable within the valve housing and normally seated against the second poppet valve to close the fourth passageway; and means for moving the first and second pistons to selectively control the flow of fluid through the first, second, third and fourth passageways.

2. The valve system of claim 1 wherein the piston moving means comprises:

first means for selectively moving the first piston to unseat the first poppet valve from the housing thereby opening the first passageway to permit fluid to flow from the inlet port to the first cylinder port.

3. The valve system of claim 2 wherein the piston moving means further comprises:

second means for moving the second piston from the second poppet valve thereby opening the fourth passageway to permit fluid from the second cylinder port to flow to the second exhaust port.

4. The valve system of claim 3 wherein the first piston moving means comprises:

first fluid pressure means for selectively directing fluid pressure on the first piston to move the first piston toward the first poppet valve and thereby open the first passageway.

5. The valve system of claim 4 wherein the second piston moving means comprises:

second fluid pressure means for selectively directing fluid pressure on the second piston to move the second piston from the second poppet valve thereby opening the fourth passageway.

6. The valve system of claim 5 wherein the first and second fluid pressure means comprise:

a first flow passage extending from the inlet port to a first upper chamber above the first piston and to a second lower chamber below the second piston;

a first valve for normally closing the first flow passage between the inlet port and the first upper and second lower chambers; and means for selectively opening the valve to permit communication of fluid pressure through the first flow passage to the first and second pistons thereby directing fluid pressure on the first and second pistons to open the first and fourth passageways.

7. The valve system of claim 6 wherein the first valve is solenoid actuated.

8. The valve system of claim 6 further comprising:

third means for selectively moving the first piston from the first poppet valve thereby opening the third passageway to permit fluid to flow from the first cylinder port to the first exhaust port; and fourth means for moving the second piston to unseat the second poppet valve from the housing thereby opening the second passageway to permit fluid from the inlet port to flow to the second cylinder port.

9. The valve system of claim 8 wherein the third piston moving means comprises:

a third fluid pressure means for directing fluid pressure on the first piston to move the first piston from the first poppet valve thereby opening the third passageway to permit fluid from the first outlet port to flow to the first exhaust port.

10. The valve system of claim 9 wherein the fourth piston moving means comprises:

fourth fluid pressure means for directing fluid pressure on the second piston to move the second piston to unseat the second poppet valve from the housing thereby opening the second passageway to permit fluid to flow from the inlet port to the second cylinder port.

11. The valve system of claim 10 wherein the third and fourth fluid pressure means comprise:

a second passage extending from the inlet port to a second upper chamber above the second piston and to a first lower chamber below the first piston;

a second valve normally closing the second flow passage between the inlet port and the second upper and first lower chambers; and means for selectively opening the second valve to permit communication of fluid pressure through the second flow passage to the first and second pistons thereby directing fluid pressure on the first and second pistons to open the second and third passageways.

12. The valve system of claim 11 wherein the second valve is solenoid actuated.

13. The valve system of claim 11 further comprising:

a first shaft fixedly attached to the first piston;

means for actuating the first shaft to move the first piston;

a second shaft fixedly attached to the second piston; and means for moving the second shaft to move the second piston.

14. The valve system of claim 13 wherein the ends of the first shaft and second shaft remote from the first and second pistons extend outside of the housing and are joined on opposite sides of the fulcrum point of a lever such that rotation of the lever moves the first and second pistons in opposite directions.

15. The valve system of claim 1 wherein the means for moving the first and second pistons comprise:

a first shaft fixedly attached to the first piston;

means for actuating the first shaft to move the first piston;

a second shaft fixedly attached to the second piston; and means for moving the second shaft to move the second piston.

16. The valve system of claim 15 wherein the ends of the first shaft and second shaft remote from the first and second pistons extend outside of the housing and are joined on opposite sides of the fulcrum point of a lever such that rotation of the lever moves the first and second pistons in opposite directions.

17. A valve system for controlling the flow of pressurized fluid, comprising:

a valve housing;

an inlet port for receiving pressurized fluid;

a cylinder port in the housing;

an exhaust port in the housing;

a first passageway extending from the inlet port to the cylinder port;

a second passageway extending from the cylinder port to the exhaust port;

a poppet valve slidably positioned within the housing and normally seated against a valve seat within the housing to close the first passageway;

a piston slidable within the housing and normally seated against the poppet valve to close the second passageway; and means for selectively moving the piston to open and close the first and second passageways to control the flow therethrough.

18. The valve system of claim 17 wherein the piston moving means comprises:

control means for selectively moving the piston between a first position where the piston is forced against the poppet valve to unseat the poppet valve from the housing thereby opening the first passageway, a second position where the piston is withdrawn from the poppet valve thereby opening the second passageway and a third position where the piston is seated against the poppet valve with the poppet valve seated against the housing to close the first and second passageways.

19. The valve system of claim 18 wherein the piston control means comprises:

a first flow channel extending from the inlet port to an upper chamber above the piston;

a first valve for normally closing the first flow channel between the inlet port and the upper chamber; and means for selectively opening the valve to permit communication of fluid pressure through the first flow channel to force the piston to the first position thereby opening the first passageway and permitting fluid flow from the inlet port to the cylinder port.

20. The valve system of claim 19 wherein the piston control means further comprises:

a second flow channel extending from the inlet port to a lower chamber below the piston;

a second valve for normally closing the second flow channel between the inlet port and the lower chamber; and means for selectively opening the second valve to permit communication of fluid pressure through the second flow channel to force the piston to the second position thereby opening the second passageway and permitting fluid flow from the cylinder port to the exhaust port.

21. The valve system of claim 20 wherein the first and second valves are solenoid actuated.

22. The valve system of claim 18 wherein the piston control means comprises:

a shaft fixedly attached to the piston; and means for actuating the shaft to move the piston between the first, second and third positions.

* * * * *